United States Patent [19]

Kiraly et al.

[11] 3,964,416

[45] June 22, 1976

[54] BOILER REACTOR

[75] Inventors: Raymond J. Kiraly, Highland Heights; Bernard H. Affeldt, Auburn; Charles R. Anspach, Willoughby Hills, all of Ohio

[73] Assignee: The United States of America as represented by the Secretary of the Navy, Washington, D.C.

[22] Filed: July 19, 1965

[21] Appl. No.: 473,573

[52] U.S. Cl. ..... 114/20 A; 122/32; 219/201; 237/1 SL

[51] Int. Cl.[2] ..... B63H 21/08

[58] Field of Search ..... 122/21, 22, 32; 60/37, 60/50, 220, 251, 258; 114/20 A, 20 R; 237/1; 219/201

[56] References Cited

UNITED STATES PATENTS 3,069,527 12/1962 Kovacik ..... 114/20 A

*Primary Examiner*—Verlin R. Pendegrass

*Attorney, Agent, or Firm*—Richard S. Sciascia; Ervin F. Johnston

EXEMPLARY CLAIM

1. A steam boiler-reactor comprising;
   a. a cylindrical casing having closures at opposite ends thereof,
   b. a steam generating tube, formed in a helical coil, disposed adjacent the inner surface of said casing and extending substantially between its opposite ends, said coil having an inlet end to which feed water may be delivered and an outlet end from which steam may be delivered to a steam engine,
   c. a cylindrical screen disposed within and adjacent the helical coil,
   d. an elongated oxidant injector nozzle tube, having a row of axially spaced injection orifices, extending longitudinally of said casing and within the space within said screen,
   e. a solid grain of cast lithium substantially filling the remainder of the space within said screen,
   f. an oxidant comprising a source of sulphur hexafluoride under pressure communicating with said nozzle tube through a valve adapted to control the rate of flow of same,
   g. said nozzle tube having longitudinally extending conduits therein through which water may be circulated for cooling it,
   h. means for supplying feed water to said conduits and thence to the inlet end of said steam generating tube,
   i. and a source of heat for melting said grain of lithium,
   j. the construction and arrangement being such that when said source of heat has melted the lithium, the oxidant may be injected into the latter for reaction with the molten lithium, the products of reaction occupying substantially the same space as the original volume of lithium, said screen preventing undesired reactions adjacent the walls of the steam coil.

2 Claims, 5 Drawing Figures

INVENTORS.
RAYMOND J. KIRALY
BERNARD H. AFFELDT
CHARLES R. ANSPACH
BY
V. C. MULLER
ATTORNEY.

BOILER REACTOR

This invention relates to improvements in steam boilers having particular utility for use in steam propelled underwater vehicles, such as torpedoes.

In underwater vehicles propelled by steam engines it has been known practice to operate the propulsion system in a closed cycle, that is, condensing the engine exhaust steam and returning the condensate to a boiler for re-evaporation and use in the engine. Such type of system is exemplified by the U.S. Pat. No. to Karig, 3,148,508. In such system the products of combustion from the steam boiler or generator are exhausted into the sea. One of the disadvantages of exhausting products of combustion into the sea, whether they be condensed gases, or a mixture of condensed and non-condensed gases is that the operational characteristics of the boiler combustion chamber are sensitive to the depth or back pressure of the sea. The exhaust of gases into the sea is also objectionable where detection of a vehicle is a problem since such gases leave a wake.

To obviate the disadvantages of exhausting boiler products of combustion into the sea, as previously referred to, boilers have been proposed which do not produce exhaust products, however, so far as is known, such proposals have not resulted in boilers in which the rate of heat generation can be properly controlled nor in boilers which will operate in a practical manner.

One of the objects of this invention is to provide an improved boiler-reactor for use with an underwater vehicle which is insentive to depth pressure.

Another object is to employ certain heat producing reactants which are inert below certain temperatures and which can be stored indefinitely.

Another object is to provide a practical embodiment of a boiler-reactor, employing such reactants, in which the rate of heat formation can be properly controlled.

Another object is to provide structural improvements in such type boiler-reactor which obviate certain structural failures.

Still further objects, advantages and salient features will become apparent from the description to follow, the appended claims, and the accompanying drawing, in which:

Figure 1:
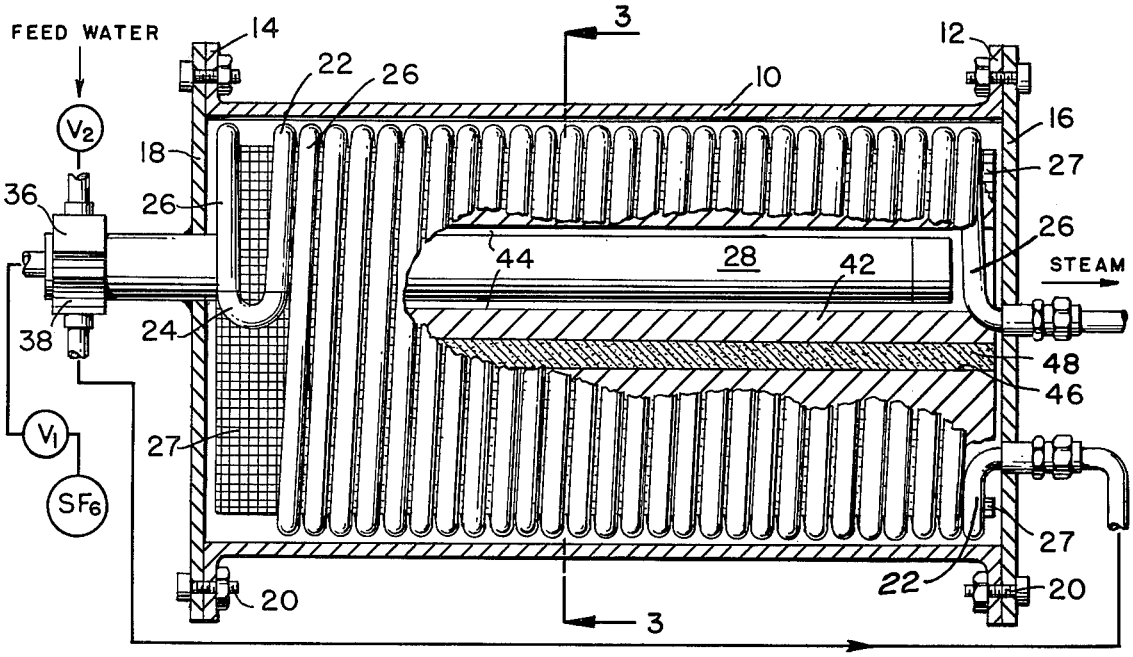
FIG. 1 is a longitudinal section of the subject of the invention, portions being broken away, and other portions being shown diagrammatically.
Figure 2:
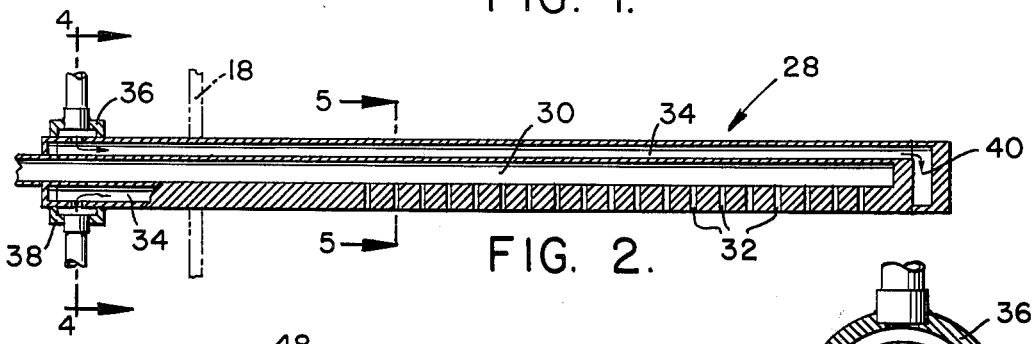
FIG. 2 is a longitudinal section of a portion of FIG. 1.

Referring now to the drawing, the subject of the invention comprises a cylindrical casing 10 having integral flanges 12, 14 at its opposite ends to which are secured end plates 16, 18, respectively, by flange bolts 20. A helical coiled stainless steel steam generating tube 22 extends from end plate 16 to adjacent end plate 18 where it is provided with a return bend 24, the tube thence returning in a like helical coil 26 to end plate 16. The two ends are welded to pipe fittings 26, 26 which are welded to plate 16. A suitable o-ring (not shown) may be disposed between the end flanges to seal the flange joints. The inside of the helical coil is lined with a cylindrical stainless steel screen 27, the purpose of which will subsequently be described.

An injector nozzle tube 28 extends longitudinally of casing 10 and is welded to end plate 18 where it passes through the plate. The nozzle tube comprises a central conduit 30 which feeds a plurality of injection apertures 32, and a plurality of surrounding conduits 34, illustrated as six. Three of these communicate with a manifold 36, and the other three communicate with manifold 38 at one end of the nozzle. At the other end, all conduits 34 communicate with a common manifold 40. As will be apparent, water may flow into manifold 36, thence through three of conduits 34 to common manifold 40, thence through the other three conduits 34 to manifold 38. Water may thus be circulated through the length of the nozzle and be returned to the same end.

Figure 3:
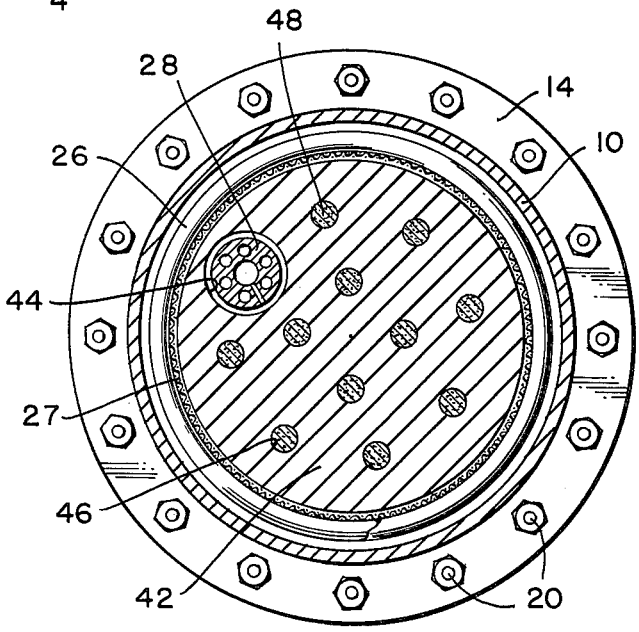
FIG. 3 is a section taken on line 3—3, FIG. 1.
Figure 4:
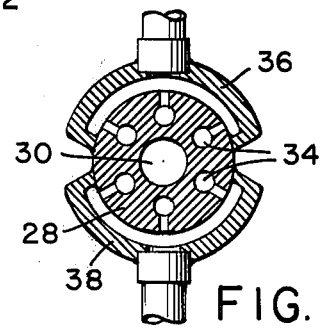
FIG. 4 is a section taken on line 4—4, FIG. 2.
Figure 5:
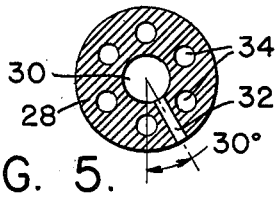
FIG. 5 is a section taken on line 5—5, FIG. 2.

As best shown in FIG. 3, a cast grain of solid fuel 42, having an aperture 44 into which the nozzle may extend, substantially fills the space within the steam coil. A plurality of apertures 46, extending between the ends of the fuel grain, may be provided which are filled with pyrotechnic starting charges 48 which may be ignited by electric squibs (not shown) disposed adjacent either or both ends of the starting charges. The preferred fuel is cast litnium, a solid at normal temperatures, which is liquified by the starting charges, such as a mixture of finely divided aluminum and potassium perchlorate. The preferred oxidant is sulphur hexafluoride ($SF_6$). The products of combustion of the fuel and oxidant, lithium fluoride and lithium sulphide, both liquids, occupy slightly less volume than the original fuel charge, hence no provisions are necessary for the disposal of the end products, all of which remain within the boiler-reactor.

In the operation of the apparatus the pyrotechnic charges are ignited, melting the lithium while $SF_6$ oxidant is injected into the molten mass, feed water being supplied to the steam generating coil. As will be apparent, the rate of generation of heat may be controlled by controlling the rate of injection of the oxidant by a valve $V_1$ and the rate of generation of steam may be controlled by a valve $V_2$, which controls the feed water to the steam coil. The $SF_6$, injected through the nozzle tube, forms bubbles within the molten lithium and reaction takes place on the surface of these bubbles. Feed water for the steam coil is first circulated through the oxidant nozzle tube to cool it and prevent decomposition of the oxidant within the nozzle tube or the ejection orifices which would otherwise result in damage or blockage of the ejection orifices.

The stainless steel screen, which lines the inside of the steam coil, is wetted by the molten fuel and reaction products and prevents reaction bubbles from penetrating through it and reacting adjacent the steam coil surfaces which would otherwise cause localized hot spots and burn-out of the steam coil. It has been found that the screen is important particularly during the latter portions of the reaction when a major portion of the fuel has been reacted and the reaction bubbles tend to change their positions in the reactor.

Dimensions and weights of the principal components of a typical steam generator for use in a 12¾ diameter torpedo are as follows:

| | | |
|---|---|---|
| Boiler-reactor diameter | 11 | inches |
| Boiler-reactor length | 17.3 | inches |
| Lithium weight | 17.2 | lbs. |
| Starting charge weight | 6.6 | lbs. |
| Oxidant tank diameter | 11. | inches |
| Oxidant tank length | 15.7 | inches |
| Oxidant ($SF_6$) weight | 38.6 | lbs. |

Such combination of fuel and oxidant produces about 310,000 Btu, based on a reaction efficiency of 80%, and produces steam at 1000°F and 1000 psi at a rate of 1200 lbs/hr for a duration about 11 minutes.

Obviously many modifications and variations of the present invention are possible in the light of the above teachings. It is therefore to be understood that within the scope of the appended claims the invention may be practiced otherwise than as specifically described.

What is claimed is:

1. A steam boiler-reactor comprising;

a. a cylindrical casing having closures at opposite ends thereof, b. a steam generating tube, formed in a helical coil, disposed adjacent the inner surface of said casing and extending substantially between its opposite ends, said coil having an inlet end to which feed water may be delivered and an outlet end from which steam may be delivered to a steam engine, c. a cylindrical screen disposed within and adjacent the helical coil, d. an elongated oxidant injector nozzle tube, having a row of axially spaced injection orifices, extending longitudinally of said casing and within the space within said screen, e. a solid grain of cast lithium substantially filling the remainder of the space within said screen, f. an oxidant comprising a source of sulphur hexafluoride under pressure communicating with said nozzle tube through a valve adapted to control the rate of flow of same, g. said nozzle tube having longitudinally extending conduits therein through which water may be circulated for cooling it, h. means for supplying feed water to said conduits and thence to the inlet end of said steam generating tube, i. and a source of heat for melting said grain of lithium, j. the construction and arrangement being such that when said source of heat has melted the lithium, the oxidant may be injected into the latter for reaction with the molten lithium, the products of reaction occupying substantially the same space as the original volume of lithium, said screen preventing undesired reactions adjacent the walls of the steam coil.

2. Apparatus in accordance with claim 1 wherein said source of heat comprising a pyrotechnic mixture, such as aluminum and potassium perchlorate, imbedded in said solid grain of lithium.

* * * * *